United States Patent [19]

Sando et al.

[11] 4,231,238

[45] Nov. 4, 1980

[54] APPARATUS FOR THE LIQUID TREATMENT OF A CLOTH

[75] Inventors: Yoshikazu Sando; Hiroshi Ishidoshiro, both of Wakayama, Japan

[73] Assignee: Sando Iron Works Co., Wakayama, Japan

[21] Appl. No.: 23,256

[22] Filed: Mar. 23, 1979

[30] Foreign Application Priority Data

Mar. 30, 1978 [JP] Japan ..... 53-41433[U]
Mar. 30, 1978 [JP] Japan ..... 53-41434[U]

[51] Int. Cl.[2] ..... D06B 3/16; D06B 21/02; D06B 23/04

[52] U.S. Cl. ..... 68/62; 68/158; 68/177; 68/183; 68/205 R; 68/207

[58] Field of Search ..... 68/62, 158, 177, 178, 68/183, 205 R, 207

[56] References Cited

U.S. PATENT DOCUMENTS

| | | | |
|---|---|---|---|
| 1,123,768 | 1/1915 | Lewis | 68/158 |
| 3,203,207 | 8/1965 | Poncelet | 68/158 X |
| 3,205,686 | 9/1965 | Norton | 68/62 X |
| 3,631,692 | 1/1972 | Garzotto | 68/62 |

FOREIGN PATENT DOCUMENTS

| | | | |
|---|---|---|---|
| 2720941 | 11/1978 | Fed. Rep. of Germany | 68/177 |
| 51-18549 | 6/1976 | Japan | 68/158 |

*Primary Examiner*—Philip R. Coe
*Attorney, Agent, or Firm*—Toren, McGeady and Stanger

[57] ABSTRACT

An apparatus for the liquid treatment of cloth consists of a U-shaped liquid tank for a treating liquid, a cloth inlet passage and a cloth outlet passage located in the tank and each having a relatively narrow spacing between vertical endless net conveyers which define the opposed sides of the passages. A plurality of liquid jet nozzles are provided along the cloth passages to spray a treating liquid against a cloth so that the cloth collides alternately with the conveyers on the opposite sides of each passage. Another cloth passage is located in the treating liquid below and forms a connecting passage between the cloth inlet-and outlet-passages. The cloth passes in a folded zigzag state through the other cloth passage. This apparatus is particularly suitable for the liquid treatment of an easily expandable cloth such as a knitted cloth by piling a plurality of the sheets thereof en bloc.

9 Claims, 3 Drawing Figures

APPARATUS FOR THE LIQUID TREATMENT OF A CLOTH

BACKGROUND OF THE INVENTION

1. Field of the Invention

The present invention relates to an apparatus for the liquid treatment of cloth in which cloth can be impregnated advantageously with a treating liquid in an untensioned state.

In subjecting a cloth to the liquid treatment such as dyeing, scouring, bleaching and washing continuously, it is necessary to impregnate the cloth with a prescribed amount of a treating liquid in an efficient manner. There have been many proposals for the liquid treatment apparatus of a cloth to perform the impregnation treatment uniformly with high efficiency. For instance, as for the liquid treatment of an easily expandable cloth such as a knitted one, a liquid treatment apparatus has been proposed to perform the treatment with no tension.

2. Description of Prior Art

However, in a conventional liquid treatment apparatus, particularly in a liquid treatment apparatus with no tension, it is the present status that a sufficient impregnation with a liquid cannot be done due to the reason that a cloth can hardly be held in a liquid tank for a sufficient period. To prolong the dwell period in the liquid medium, it has been considered to enlarge the liquid treating tank, but there are problems in the space required for and cost of the apparatus. An apparatus has also been proposed to use a deep liquid tank having a U-shaped cloth passage, but such an apparatus has not as yet any distinguished merit in prolonging the dwell period of the cloth in the liquid medium.

SUMMARY OF THE INVENTION

The present invention affords an adequate dwell time. The principal object of the present invention is, in a liquid tank having a U-shaped cloth passage, to U-turn the cloth by folding it zigzag at the lower portion of the passage to increase the amount of the cloth held in the tank and thus to prolong its dwell period in liquid medium.

Another object of the invention is to offer an apparatus in which a cloth can be transferred through a U-shaped passage smoothly with no tension by U-turning the cloth at the lower portion of the U-shaped passage without destroying the zigzag arrangement of the cloth passing through the U-shaped passage in a folded state. While such an arrangement of a cloth, as in the first object, is apt to be destroyed frequently to tangle the cloth owing to the buoyancy of the cloth and others, the second object is to avoid such a problem.

BRIEF EXPLANATION OF THE DRAWINGS

The figures show sectional side views of different embodiments of the present inventive apparatus for the liquid treatment of a cloth.

DETAILED DESCRIPTION OF THE INVENTION

The present invention will be explained in detail according to the accompanied figures in the following.

Figure 1:
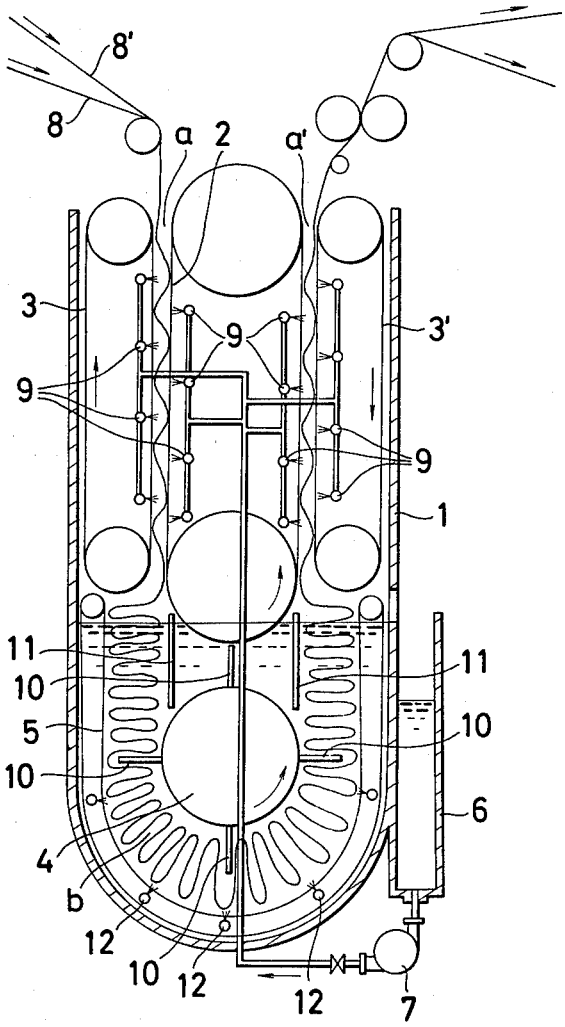
FIG. 1 displaying Example 1.

In FIG. 1, (1) is a nearly U-shaped liquid tank. In about an upper half portion of the tank (1), there are provided a freely rotatable central endless net conveyor (2) extending vertically and a pair of outer endless net conveyors (3) and (3') which are equipped rotatably along the central net conveyor (2) in parallel on both sides thereof to form narrow cloth inlet- and outlet-passages (a) and (a') therebetween. In about a lower half portion of the liquid tank (1), there are provided a freely rotatable rotary drum (4) at the center and a freely rotatable endless net conveyor (5) along the wall to form a cloth passage in liquid medium (b) broader than the cloth inlet- and outlet-passages. (6) is a liquid receiving tank to receive a treating liquid flowing over the liquid tank (1), and the liquid receiving tank (6) is connected through a pump (7) to a plurality of liquid jet nozzles (9) so as to jet the liquid received in the liquid receiving tank (6) against a cloth to be treated passing through the cloth passages (a) and (a') and to return the jetted liquid to the liquid tank (1).

Four comb-like cloth holding frames (10) are attached to the rotary drum (4) and extend radially outwardly from it at equal intervals so as to be rotatable with the rotation of the rotary drum (4), thereby avoiding contact with comb-like guide frames (11) provided vertically along the broader cloth passages between the central conveyor (2) and the rotary drum (4). Namely, the teeth of the cloth holding frames (10) are arranged so as to pass the gaps of the guide frames (11). (12) are a plurality of steam jet pipes provided at the bottom of the liquid tank (1).

While the construction of the apparatus in Example 1 is as above mentioned, the operation process by using said apparatus will be described in the following. At first, the endless net conveyors (2), (3) and (3') are rotated respectively in the direction of the arrow with a prescribed speed, and the drum (4) and the endless net conveyor (5) are rotated at the lower portion of the liquid tank also respectively in the direction of the arrow but with a speed slower than the conveyors (2), (3) and (3'). The treating liquid is sprayed through the liquid jet nozzles (9) by driving the pump (7).

Two sheets of cloth (8), (8') piled one on the other en bloc are then transferred into the cloth inlet passage (a), sent down therethrough by rotating the conveyors (2) and (3), and the liquid is sprayed from the liquid jet nozzles (9). The cloths collide alternately with the conveyors (2) and (3) on both sides of the cloth passage (a) due to the jetting liquid pressure from the nozzles (9), releasing the weight of the cloths of their own, so that the cloths descend zigzag through the cloth passage (a) in a relaxed state with no tension. The cloths thus sent down are immersed in a treating liquid in the liquid tank (1) and are transferred in a folded state zigzag through the broader cloth passage in liquid medium (b) because the revolution speeds of the drum (4) and the conveyor (5) are slow and the buoyancy of the cloth is superposed. Furthermore, since the drum is equipped with the cloth holding frames (10) rotating together with the drum (4), the folded cloths are transferred orderly without missing their arrangement and with no tension, and can be U-turned smoothly in the liquid medium.

In consequence of the effect that the cloths are folded zigzag in the liquid medium, there is such merit in that the cloths are immersed in the treating liquid for a long time prolonging the reaction time and affording an efficient liquid treatment.

Figure 2:
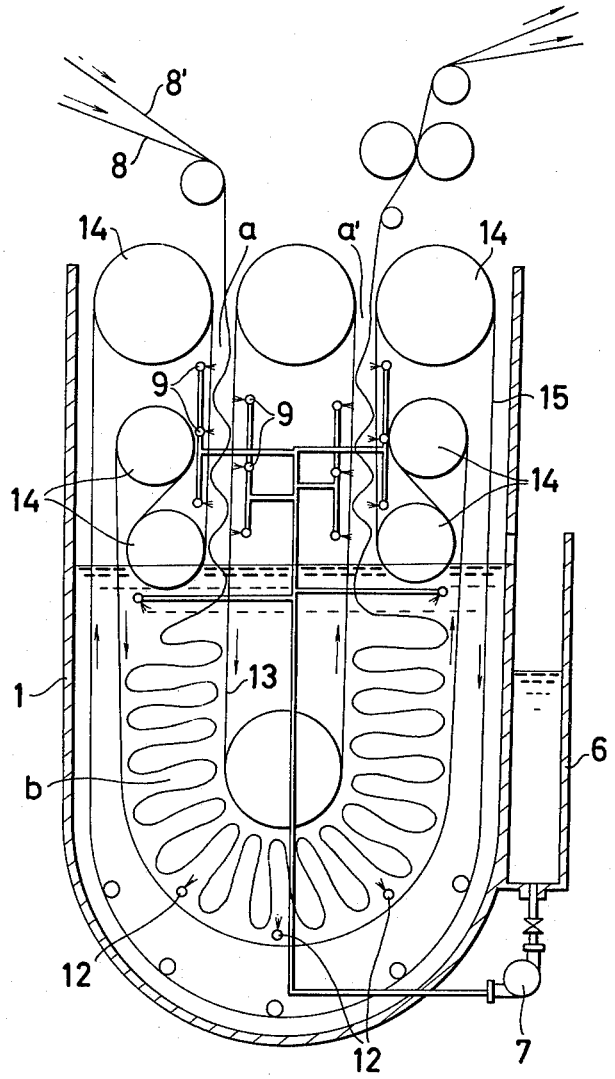
FIG. 2 displaying Example 2.

Example 2 in FIG. 2 differs from Example 1 in its construction for transferring the cloth in the liquid tank.

The cloth transferring construction in this example comprises a central endless net conveyer (13) extending vertically down to the lower portion of the liquid tank and an endless net conveyer (15) passing around the central conveyer (13) in a way as shown in the figure with the aid of a plurality of guide rolls (14) provided on both sides of said central conveyer (13). The means to flow the treating liquid and other operation processes are the same as in Example 1. In this example, a pair of endless net conveyers (13) and (15) forms the cloth inlet- and outlet-passages (a) and (a') as well as a cloth passage in liquid medium (b) to transfer the cloth in a folded state simultaneously. Therefore, Example 2 has the merit in that the conveyers are spared as compared with Example 1 and the construction of the apparatus is simplified.

Figure 3:
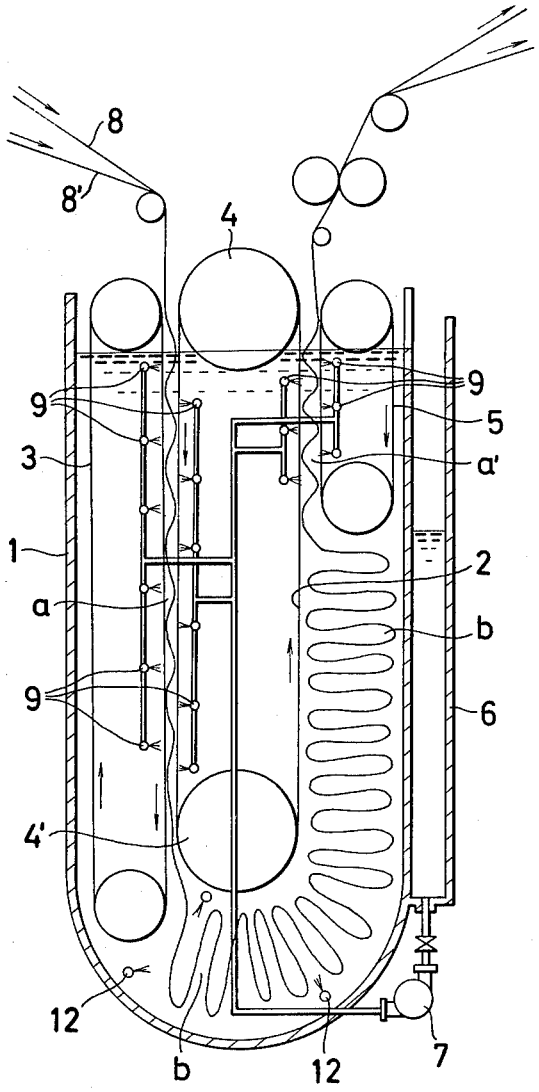
FIG. 3 displaying Example 3.

FIG. 3 shows the construction of the apparatus in Example 3. (1) is a nearly U-shaped liquid tank. In the central portion of this liquid tank, a central endless net conveyer (2) is provided vertically down to the lower portion of the liquid tank so as to rotate freely guided by a pair of guide rolls (4) and (4') situated at a certain distance. (3) is an inlet endless net conveyer provided vertically along one side of the central endless net conveyer (2) extending over the whole length thereof forming a narrow space therebetween, and (5') is an outlet endless net conveyer provided vertically along the other side of the central endless net conveyer (2) within the upper portion thereof forming a narrow space therebetween. Thus, narrow cloth inlet- and outlet-passages (a) and (a') are formed respectively between the central endless net conveyer (2) and the inlet endless net conveyer (3) and between the central endless net conveyer (2) and the outlet endless net conveyer (5'). In this example, the cloth inlet- and outlet-passages (a) and (a') are filled with the treating liquid.

At the lower side of both of the cloth inlet- and outlet-passages (a) and (a') a vertically extending, nearly J-shaped cloth passage (b) broader than the cloth inlet- and outlet-passages is formed between the central endless net conveyer (2) and the inner wall of the liquid tank (1) as shown in the figure. (6) is a liquid receiving tank for receiving the treating liquid flowing over the liquid tank (1), and the liquid receiving tank (6) is connected to a plurality of liquid jet nozzles (9) so as to jet the liquid received in the liquid receiving tank (6) by means of the driving force of a pump (7) against the cloth passing through the cloth passages (a) and (a') and to return the jetted liquid to the liquid tank (1). (12) are a plurality of steam jet pipes at the bottom of the liquid tank (1).

In the process using the apparatus in this example, the endless net conveyers (2), (3) and (3') are rotated respectively in the direction of the arrow, and the treating liquid is sprayed through the liquid jet nozzles (9) by driving the pump (7). Then, two sheets of a cloth (8) and (8') piled en bloc are transferred into the cloth passage (a) in the treating liquid in the liquid tank (1). The cloths adopt a wave-like configuration by receiving the liquid pressure due to the jetting of liquid from the liquid jet nozzles (9), they are pressed alternately to collide with both of the endless net conveyers (2) and (3), so that the cloths are sent down in a zigzag manner by rotating the conveyers (2) and (3) through the liquid medium in a relaxed state with no tension. The cloths thus transferred successively to the bottom portion of the liquid tank are folded zigzag with no tension in the broader cloth passage (b), are transferred smoothly toward the outlet due to their own buoyancy, and are supplied to the cloth outlet passage (a') situated between the two endless net conveyers (2) and (5'). The cloths in this cloth passage (a') are pressed alternately to collide with the both endless net conveyers (2) and (5') due to the jetting liquid pressure of the liquid jetted from the liquid jet nozzles (9), so that the cloths are transferred upward with no tension by the driving force of the endless net conveyers (2) and (5').

As above explained, the present inventive apparatus enables a cloth to be transferred with a single sheet or two more sheets piled en bloc, in a liquid tank in a relaxed state with no tension, so that the apparatus is quite effective to treat an easily expandable cloth such as a knitted one in a liquid medium. Since the cloth is immersed in the liquid medium in a folded zigzag state the impregnation duration of the cloth is prolonged, and therefore, the impregnation can be done uniformly and sufficiently. Moreover, since the present inventive apparatus is arranged so that the cloth existing at the bottom of the liquid tank can float up in a folded state by its own buoyancy, the cloth can be transferred orderly with no entanglement in the liquid tank.

The present invention is particularly effective in the liquid treatment of two or more sheets of an easily expandable cloth en bloc at the same time.

What is claimed is:

1. An apparatus for the liquid treatment of a cloth comprising an upwardly arranged, open top, U-shaped liquid tank, said tank consisting of an upper portion and a lower portion and at least the lower portion thereof arranged to contain a treating liquid, endless net conveyer means located within said upper and lower portions of said tank for conveying a cloth therethrough, said endless net conveyer means including a plurality of upwardly extending net conveyer sections, a first and a second said net conveyer sections disposed in relatively closely spaced relation within the upper portion of said tank and forming therebetween an inlet passage for feeding cloth downwardly into said tank, third and fourth said net conveyer sections disposed in relatively closely spaced relation in the upper part of said tank and forming therebetween an outlet passage for removing cloth upwardly from said tank, a plurality of liquid jet nozzles spaced apart along each of the opposite sides of said inlet and outlet passages and said jet nozzles on the opposite sides of said passages being offset in the upward direction relative to one another and positioned relative to said net conveyer sections forming said passages so that said jet nozzles direct a treating liquid through said net conveyer sections in the generally horizontal direction for colliding alternatively with opposite sides of the cloth passing through said passages so that the cloth alternately collides with said conveyer sections forming the opposite sides of said passages, said conveyer means forming at least a side of a lower cloth passage located within said lower part of said tank and extending between the lower end of said inlet passage and the lower end of said outlet passage, said tank having a liquid level therein located at least at the upper end of said lower cloth passage, the opposed sides of said lower cloth passage being spaced a greater distance apart than said conveyer sections forming said inlet and outlet passages so that the cloth entering said lower cloth passage from said inlet passage assumes a folded over state and remains in the folded over state between the end thereof where the cloth enters said lower cloth passage from said inlet passage and the end thereof where the cloth exists from said lower cloth passage and enters said outlet passage.

2. An apparatus for the liquid treatment of a cloth, as set forth in claim 1, wherein said endless net conveyer means includes upwardly extending first and second endless net conveyers located in the upper portion of said tank and having upwardly extending conveyer sections spaced laterally apart with said first net conveyer including said first net conveyer section and said second net conveyer including said fourth net conveyer section with said first and fourth net conveyer sections facing one another and spaced laterally apart, an upwardly extending third endless net conveyer located within the upper portion of said tank and located between said first and second net conveyers, said third endless net conveyer including said second and third net conveyer sections, said first, second, third and fourth conveyer sections disposed in parallel relation, and said endless net conveyer means includes a U-shaped fifth net conveyer section located in said lower portion of said tank and extending along the inner surface of said tank downwardly from the liquid level therein to the lower end of said tank, a rotary drum located within the lower portion of said tank and spaced centrally between the sides of said tank below the liquid level therein and with the lower surface of said drum spaced upwardly from said fifth net conveyer section at the bottom of said tank, and said lower cloth passage being defined between the outer surface of said drum and the inner surface of said fifth net conveyer section.

3. An apparatus for the liquid treatment of cloth, as set forth in claim 2, wherein comb-like cloth holding frames are attached to and extend radially outwardly from the outer surface of said drum into said lower cloth passage, said frames being disposed equiangularly apart around said drum.

4. An apparatus for the liquid treatment of cloth, as set forth in claim 1, wherein said endless net conveyer means comprises a generally U-shaped endless net conveyer located in the upper and lower portions of said tank with the lower part of said U-shaped conveyer extending down to the lower end of said tank, each leg of said U-shaped net conveyer being disposed in laterally spaced relation to the other, a central endless net conveyer located in the upper and lower portions of said tank and located between the legs of said U-shaped net conveyer, said central net conveyer being spaced inwardly from said U-shaped net conveyer for forming therebetween said inlet and outlet passages and said lower cloth passage extending between said inlet and outlet passages, said central net conveyer having a pair of upwardly extending net conveyer sections forming said second and third net conveyer sections with said second and third net conveyer sections extending downwardly from said upper portion to said lower portion of said tank and defining one lateral side of each of said inlet passage said outlet passage and said lower cloth passage, and said U-shaped net conveyer including a plurality of guide rolls with said U-shaped net conveyer extending over said guide rolls and forming said first and fourth net conveyer sections in the upper portion of said tank and a fifth U-shaped net conveyer section located in the lower portion of said tank with said fifth net conveyer section spaced laterally outwardly from said second and third net conveyer sections of said central net conveyer by a distance greater than the distance between said first and second and said third and fourth net conveyer sections.

5. An apparatus for the liquid treatment of cloth, as set forth in claims 2 and 4, wherein said liquid level within said tank is located in the upper part of said lower portion of said tank and said inlet and outlet passages being located above said liquid level.

6. An apparatus for the liquid treatment of cloth, as set forth in claim 1, wherein said endless net conveyer means comprises a first endless net conveyer located in the upper portion of said tank and extending downwardly into the lower portion of said tank and located adjacent one side of said tank, a second endless net conveyer located in the upper portion of said tank and located adjacent the opposite side of said tank from said first net conveyer, said first net conveyer including said first net conveyer section, said second net conveyer including said fourth net conveyer section with said first and fourth net conveyer sections being disposed in generally parallel relation and with said first net conveyer section extending downwardly from said upper portion to said lower portion of said tank and said second net conveyer section located for its full extent within said upper portion of said tank, a third endless net conveyer located within said tank and extending downwardly from the upper portion to the lower portion thereof with said third conveyer located between said first and second conveyers, said third conveyer comprising said second and third net conveyer sections, said first and second net conveyer sections forming said inlet passage extending downwardly from said upper portion to said lower portion of said tank, said third and fourth net conveyer sections forming said outlet passage completely in said upper portion of said tank and the lower end of said third net conveyer and the portion of said third net conveyer section located below said second net conveyer forming the inner side of said lower cloth passage extending between said inlet passage and said outlet passage, the lower portion of said tank and the side of said tank adjacent to and located below said second net conveyer forms the outer side of said lower cloth passage extending between said inlet passage and said outlet passage.

7. An apparatus for the liquid treatment of a cloth, as set forth in claim 6, wherein the liquid level within said tank is located in the upper part of the upper portion of said tank with said inlet and outlet passages and said lower cloth passage all located below the liquid level.

8. An apparatus for the liquid treatment of cloth, as set forth in claim 1, wherein steam jet pipes are located in the lower portion of said lower cloth passage for directing steam against at least one side of the cloth passing through said lower cloth passage.

9. An apparatus for the liquid treatment of cloth, as set forth in claim 1, wherein a liquid receiving tank is located exteriorly of said tank, means interconnecting the lower end of said liquid receiving tank to said plurality of liquid jet nozzles, said means including a pump for supplying liquid from said receiving tank to said jet nozzles.

* * * * *